US006823846B2

(12) United States Patent
Mattes

(10) Patent No.: US 6,823,846 B2
(45) Date of Patent: Nov. 30, 2004

(54) FUEL INJECTION DEVICE FOR AN INTERNAL COMBUSTION ENGINE

(75) Inventor: Patrick Mattes, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/420,861

(22) Filed: Apr. 23, 2003

(65) Prior Publication Data

US 2004/0016421 A1 Jan. 29, 2004

(30) Foreign Application Priority Data

Apr. 23, 2002 (DE) ..... 102 18 024

(51) Int. Cl.[7] ..... F02M 41/00
(52) U.S. Cl. ..... 123/456; 123/464
(58) Field of Search ..... 123/456, 447, 123/464, 463, 457

(56) References Cited

U.S. PATENT DOCUMENTS 3,507,263 A * 4/1970 Long ..... 123/455
4,142,497 A * 3/1979 Long ..... 123/456
6,092,509 A * 7/2000 Tanabe et al. ..... 123/447
6,112,721 A * 9/2000 Kouketsu et al. ..... 123/447
6,378,498 B2 * 4/2002 Kohketsu et al. ..... 123/447
6,615,807 B2 * 9/2003 Rembold et al. ..... 123/516
6,684,856 B2 * 2/2004 Tanabe et al. ..... 123/447

FOREIGN PATENT DOCUMENTS

DE 19941770 * 3/2001

* cited by examiner

*Primary Examiner*—Mahmoud Gimie
(74) *Attorney, Agent, or Firm*—Ronald E. Greigg

(57) ABSTRACT

The fuel injection device has a high-pressure pump that supplies highly pressurized fuel to at least one high-pressure reservoir connected to injectors disposed in cylinders of an engine, wherein the injectors are connected to a common low-pressure reservoir. A pressure holding valve maintains a predetermined low pressure in the low-pressure reservoir. A pressure regulating valve regulates the pressure in the high-pressure reservoir by diverting fuel from the at least one high-pressure reservoir through a diversion connection into a low-pressure region. The diversion connection of the pressure regulating valve is connected to the low-pressure reservoir so that the low-pressure reservoir is filled with fuel.

16 Claims, 2 Drawing Sheets

FUEL INJECTION DEVICE FOR AN INTERNAL COMBUSTION ENGINE

BACKGROUND OF THE INVENTION

1. Field of the Invention

The invention is directed to an improved fuel injection device for an internal combustion engine.

2. Description of the Prior Art

A fuel injection device, known from DE 199 41 770 A1, has a high-pressure pump that supplies highly pressurized fuel into at least one high-pressure reservoir connected to injectors disposed in cylinders of the engine. The injectors are connected to a common return line, which constitutes a low-pressure reservoir. A minimum pressure must be maintained in the low-pressure reservoir in order to assure the proper functioning of the injectors, particularly if they have a control valve with a piezoelectric actuator and a hydraulic pressure booster device.

OBJECT AND SUMMARY OF THE INVENTION

The fuel injection device according to the invention has the advantage over the prior art that the pressure holding valve permits a minimum pressure to be maintained in the low-pressure reservoir. In addition, it is also possible to fill the low-pressure reservoir with fuel specifically by diverting fuel from the high-pressure reservoir by means of the pressure regulating valve, without requiring an additional fuel-supply pump. The fuel diverted from the high-pressure reservoir is heated in the course of this, which quickly brings the injectors to their operating temperature and stabilizes their operation.

Other advantageous embodiments and modifications of the fuel injection device according to the invention are disclosed. In a simple manner, one embodiment permits the diversion connection to be switched between the low-pressure reservoir and the relief region, which makes it possible to avoid excessively intense heating of the injectors. Another embodiment permits a pressure increase in the low-pressure reservoir during starting of the engine and thus makes it possible for the engine to start reliably.

BRIEF DESCRIPTION OF THE DRAWINGS

The invention will be better understood and further objects and advantages thereof will become more apparent from the ensuing detailed description of preferred embodiments taken in conjunction with the drawings, in which.

DESCRIPTION OF THE PREFERRED EMBODIMENTS

Figure 1:
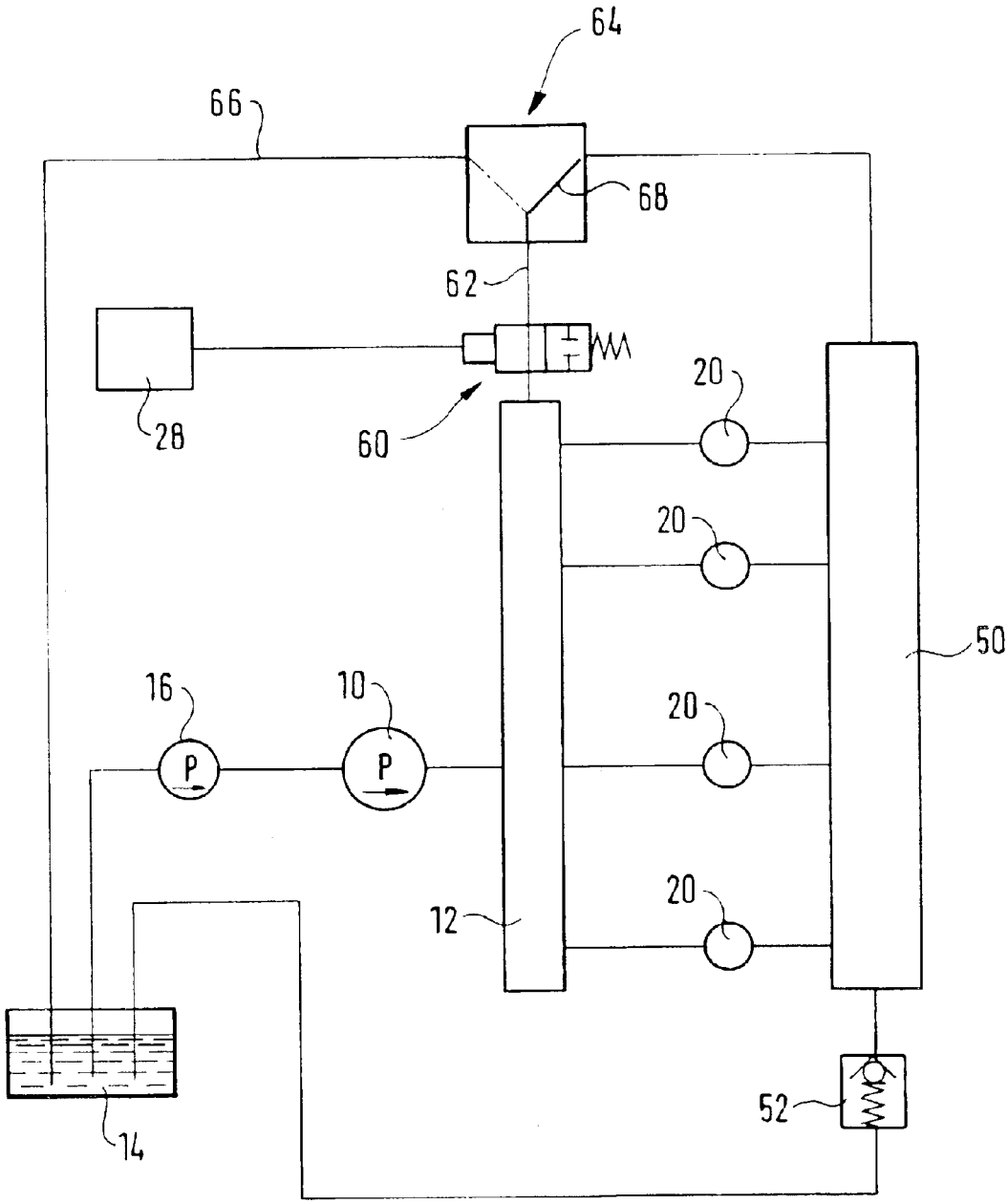
FIG. 1 shows a simplified, schematic depiction of a fuel injection device embodying the invention for use in an internal combustion engine.

FIG. 1 shows a fuel injection device for an internal combustion engine of a motor vehicle. Preferably, the engine is an autoignition engine. The fuel injection device has a high-pressure pump 10 that supplies highly pressurized fuel to at least one high-pressure reservoir 12. The high-pressure pump 10 is mechanically driven by the engine and has one or more pump elements, which are set into a stroke motion by a drive unit. A fuel-supply pump 16 supplies fuel from a fuel tank 14 to the suction side of the high-pressure pump 10.

The fuel-supply pump 16 can be driven by the high-pressure pump 10 or can be driven by the engine along with the high-pressure pump 10. Alternatively, the fuel-supply pump 16 can also have its own drive unit, for example an electromotive drive unit.

Figure 2:
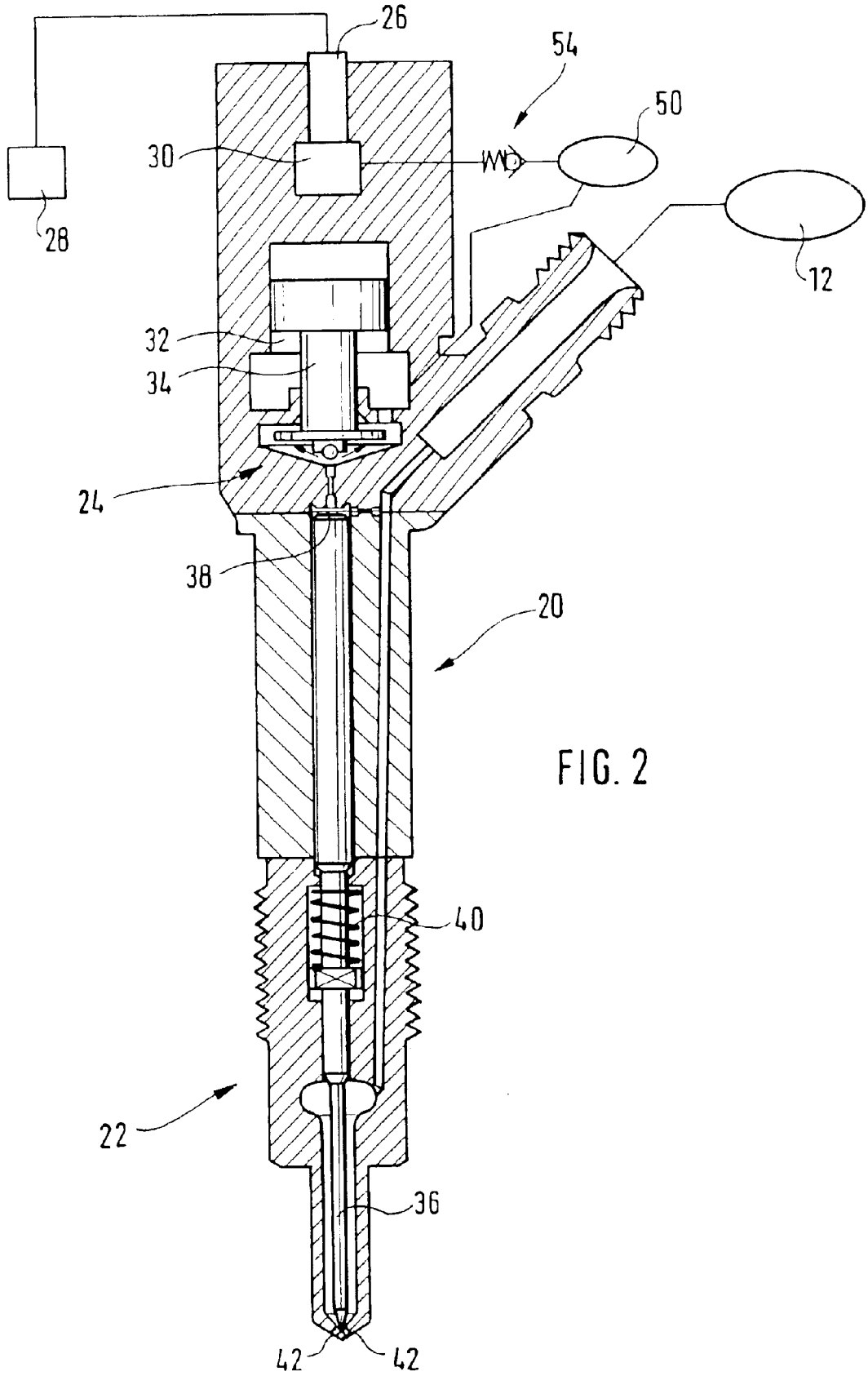
FIG. 2 shows an enlarged depiction of an injector of the fuel injection device.

The high-pressure reservoir 12 is connected to injectors 20 disposed in the cylinders of the engine. As shown in FIG. 2, the injectors 20 each have a fuel injection valve 22 and a control valve 24. The control valve 24 has a piezoelectric actuator 26, which is connected to an electronic control unit 28 that supplies it with an electric voltage. Depending on the voltage that activates it, the piezoelectric actuator 26 changes in length and thus, by means of a hydraulic pressure booster device 30, produces a pressure change in an actuator pressure chamber 32, which changes the position of a control valve element 34. The fuel injection valve 22 has an injection valve element 36 that is acted on in an opening direction by the pressure prevailing in the high-pressure reservoir 12 and is acted on in a closing direction by the pressure prevailing in a control pressure chamber 38 and possibly also by a closing spring 40. The injection valve element 36 controls at least one injection opening 42. The control pressure chamber 38 is connected to the high-pressure reservoir 12 and, by means of a connection that is controlled by the control valve element 34, is connected to a relief region, the function of which can be at least indirectly served by the fuel tank 14. If the actuator 26 is not activated and is therefore without voltage, then the pressure in the actuator pressure chamber 32 is low so that the control valve element 34 breaks the connection of the control pressure chamber 38 to the relief region. Consequently, high pressure equivalent to that in the high-pressure reservoir 12 prevails in the control pressure chamber 38, and the injection valve element 36 is held in its closed position so that no fuel injection takes place. If the control unit 28 applies an electric voltage to the actuator 26, then the pressure in the actuator pressure chamber 32 increases so that the control valve element 34 opens the connection of the control pressure chamber 38 to the relief region. This allows fuel to flow out of the control pressure chamber 38 so that the pressure drops and the injection valve element 36 moves in the opening direction so that a fuel injection occurs.

The hydraulic pressure booster devices 30 of the injectors 20 are connected to a common low-pressure reservoir 50. A pressure holding valve 52 maintains a predetermined pressure in the low-pressure reservoir 50, for example between 5 and 20 bar. If the predetermined pressure is exceeded, then the pressure holding valve 52 opens and allows fuel to flow out of the low-pressure reservoir 50, for example at least indirectly into the fuel tank 14, which functions as a relief region. It is possible for the fuel that is diverted from the control pressure chamber 38 by means of the control valve element when the control valve 24 is open to be conveyed into the low-pressure reservoir 50 that functions as a relief region. Each connection of a pressure booster devices 30 to the low-pressure reservoir 50 contains a check valve 54 that opens toward the pressure booster device 30, which permits the pressure booster device 30 to be filled from the low-pressure reservoir 50, but does not permit any fuel to flow out of the pressure booster device 30 into the low-pressure reservoir 50. The low-pressure reservoir 50 assures that the pressure booster devices 30 are filled with fuel and consequently assures that the injectors function properly.

The fuel injection device also has a pressure regulating valve 60 that can regulate the pressure in the high-pressure reservoir 12. The pressure regulating valve 60 can divert fuel from the high-pressure reservoir 12, which reduces the pressure in the high-pressure reservoir 12. The pressure regulating valve 60 can be embodied as an electrically actuated valve, for example as a 2/2-way valve, which can be switched between a closed position in which no fuel can flow out of the high-pressure reservoir 12 and an open position in which fuel can flow out of the high-pressure reservoir 12. The control unit 28 triggers the pressure regulating valve 60, which permits a variable pressure to be adjusted in the high-pressure reservoir 12. The pressure regulating valve 60 has a diversion connection 62 to a low-pressure region to which the fuel diverted from the high-pressure reservoir 12 is supplied. According to the invention, the diversion connection 62 of the pressure regulating valve 60 can be connected to the low-pressure reservoir 50 as a low-pressure region.

The diversion connection 62 of the pressure regulating valve 60 contains a reversing valve 64, which can connect the diversion connection 62 with either the low-pressure reservoir 50 or a return 66 into the fuel tank 14 as a relief region. The reversing valve 64 can, for example, be switched in a temperature-dependent manner in such a way that when the fuel temperature is below a limit temperature, the diversion connection 62 is connected to the low-pressure reservoir 50 and when the fuel temperature is above the limit temperature, the diversion connection 62 is connected to the return 66 to the fuel tank 14. The reversing valve 64 can have a switch element 68 in contact with the fuel, which changes shape depending on the fuel temperature and thus executes the switch. The switch element 68 can, for example, be comprised of bimetal, which in the event of a temperature change, produces the shape change due to the differing expansion coefficients of the two different metals.

A reliable function of the injectors 20 requires a complete filling of their hydraulic pressure booster devices 30, which is assured through their connection to the low-pressure reservoir 50. The fuel quantity diverted by the pressure regulating valve 60 makes it possible to fill the low-pressure reservoir 50 with fuel. During the starting of the engine, it is possible for the control unit 28 to trigger the pressure regulating valve 60 in such a way that it permits fuel to flow out of the high-pressure reservoir 12, which fuel is supplied to the low-pressure reservoir 50 and generates the necessary low pressure there, thus assuring a filling of the hydraulic pressure booster devices 30 of the injectors 20. This makes it possible for the engine to start reliably even if the fuel tank 14 has previously been completely emptied or if the engine is being started while hot. In addition, the fuel diverted from the high-pressure reservoir 12 can initially achieve a heating of the injectors 20 so that they quickly reach a stable operating temperature. The reversing valve 64 prevents an excessively intense heating of the injectors 20 by connecting the diversion connection 62 of the pressure regulating valve 60 directly to the return 66 when the fuel temperature is high so that no more fuel is supplied to the low-pressure reservoir. As a result, an additional fuel-supply pump is not required in order to fill the low-pressure reservoir 50.

The foregoing relates to preferred exemplary embodiments of the invention, it being understood that other variants and embodiments thereof are possible within the spirit and scope of the invention, the latter being defined by the appended claims.

I claim:

1. A fuel injection device for an internal combustion engine, comprising at least one high pressure reservoir (12)

a high-pressure pump (10) that supplies highly pressurized fuel to the at least one high-pressure reservoir (12), a plurality of injectors (20) disposed in cylinders of the engine and connected to the high pressure reservoir, a common low-pressure reservoir (50) connected to said injectors (20), a pressure holding valve (52) maintaining a predetermined low pressure in the low-pressure reservoir (50), a pressure regulating valve (60) which can regulate the pressure in the high-pressure reservoir (12) by diverting fuel from the at least one high-pressure reservoir (12) through a diversion connection (62) into a low-pressure region, and the diversion connection (62) of the pressure regulating valve (60) connected to the low-pressure reservoir (50).

2. A fuel injection device according to claim 1, further comprising a reversing valve (64) which can connect the diversion connection (62) of the pressure regulating valve (60) with either the low-pressure reservoir (50) or a relief region (66, 14).

3. The fuel injection device according to claim 2, wherein the reversing valve (64) is switched depending on the temperature of the fuel in such a way that at a low fuel temperature, the diversion connection (62) of the pressure regulating valve (60) is connected to the low-pressure reservoir (50) and at a high fuel temperature, the diversion connection (62) of the pressure regulating valve (60) is connected to the relief region (66, 14).

4. The fuel injection device according to claim 3, wherein the reversing valve (64) has a switch element (68) in contact with the fuel, which switch element changes shape depending on the temperature and thus executes the switch.

5. The fuel injection device according to claim 1, wherein during starting of the engine, the pressure regulating valve (60) is triggered in such a way that it diverts fuel from the high-pressure reservoir (12), and the diversion connection (62) of the pressure regulating valve (60) is connected to the low-pressure reservoir (50).

6. The fuel injection device according to claim 2, wherein during starting of the engine, the pressure regulating valve (60) is triggered in such a way that it diverts fuel from the high-pressure reservoir (12), and the diversion connection (62) of the pressure regulating valve (60) is connected to the low-pressure reservoir (50).

7. The fuel injection device according to claim 3, wherein during starting of the engine, the pressure regulating valve (60) is triggered in such a way that it diverts fuel from the high-pressure reservoir (12), and the diversion connection (62) of the pressure regulating valve (60) is connected to the low-pressure reservoir (50).

8. The fuel injection device according to claim 4, wherein during starting of the engine, the pressure regulating valve (60) is triggered in such a way that it diverts fuel from the high-pressure reservoir (12), and the diversion connection (62) of the pressure regulating valve (60) is connected to the low-pressure reservoir (50).

9. The fuel injection device according to claim 1, wherein each of the injectors (20) comprises a fuel injection valve (22) with a control valve (24) that controls it, when the control valve (24) comprise a piezoelectric actuator (26) and a hydraulic pressure booster device (30) associated with it, and wherein the hydraulic pressure booster device (30) is connected to the low-pressure reservoir (50) and is filled from this low-pressure reservoir (50).

10. The fuel injection device according to claim 2, wherein each of the injectors (20) comprises a fuel injection valve (22) with a control valve (24) that controls it, when the control valve (24) comprise a piezoelectric actuator (26) and a hydraulic pressure booster device (30) associated with it, and wherein the hydraulic pressure booster device (30) is connected to the low-pressure reservoir (50) and is filled from this low-pressure reservoir (50).

11. The fuel injection device according to claim 3, wherein each of the injectors (20) comprises a fuel injection valve (22) with a control valve (24) that controls it, when the control valve (24) comprise a piezoelectric actuator (26) and a hydraulic pressure booster device (30) associated with it, and wherein the hydraulic pressure booster device (30) is connected to the low-pressure reservoir (50) and is filled from this low-pressure reservoir (50).

12. The fuel injection device according to claim 4, wherein each of the injectors (20) comprises a fuel injection valve (22) with a control valve (24) that controls it, when the control valve (24) comprise a piezoelectric actuator (26) and a hydraulic pressure booster device (30) associated with it, and wherein the hydraulic pressure booster device (30) is connected to the low-pressure reservoir (50) and is filled from this low-pressure reservoir (50).

13. The fuel injection device according to claim 5, wherein each of the injectors (20) comprises a fuel injection valve (22) with a control valve (24) that controls it, when the control valve (24) comprise a piezoelectric actuator (26) and a hydraulic pressure booster device (30) associated with it, and wherein the hydraulic pressure booster device (30) is connected to the low-pressure reservoir (50) and is filled from this low-pressure reservoir (50).

14. The fuel injection device according to claim 6, wherein each of the injectors (20) comprises a fuel injection valve (22) with a control valve (24) that controls it, when the control valve (24) comprise a piezoelectric actuator (26) and a hydraulic pressure booster device (30) associated with it, and wherein the hydraulic pressure booster device (30) is connected to the low-pressure reservoir (50) and is filled from this low-pressure reservoir (50).

15. The fuel injection device according to claim 7, wherein each of the injectors (20) comprises a fuel injection valve (22) with a control valve (24) that controls it, when the control valve (24) comprise a piezoelectric actuator (26) and a hydraulic pressure booster device (30) associated with it, and wherein the hydraulic pressure booster device (30) is connected to the low-pressure reservoir (50) and is filled from this low-pressure reservoir (50).

16. The fuel injection device according to claim 8, wherein each of the injectors (20) comprises a fuel injection valve (22) with a control valve (24) that controls it, when the control valve (24) comprise a piezoelectric actuator (26) and a hydraulic pressure booster device (30) associated with it, and wherein the hydraulic pressure booster device (30) is connected to the low-pressure reservoir (50) and is filled from this low-pressure reservoir (50).

* * * * *